US006390468B1

(12) United States Patent
Michel et al.

(10) Patent No.: US 6,390,468 B1
(45) Date of Patent: May 21, 2002

(54) ADJUSTABLE RAMP FOR SHEET MATERIAL HANDLING DEVICES

(75) Inventors: Teodoro Ortiz Michel, Jalisco (MX); Laurent A. Regimbal, Eagle, ID (US); Roland Boss, Jalisco (MX)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/619,965

(22) Filed: Jul. 20, 2000

(51) Int. Cl.[7] ..... B65H 5/00
(52) U.S. Cl. ..... 271/264; 271/306
(58) Field of Search ..... 271/264, 289, 271/290, 69, 306

(56) References Cited

U.S. PATENT DOCUMENTS 3,853,314 A * 12/1974 Anderson
4,618,135 A * 10/1986 Greiner et al. ..... 271/264 X
6,003,864 A * 12/1999 Kuo et al. ..... 271/69 X

* cited by examiner

*Primary Examiner*—David H. Bollinger

(57) ABSTRACT

A sheet material transfer guide is described in the context of a sheet material handling system including a first sheet material processing device and a second sheet material processing device. The transfer guide includes an outfeed mechanism on the first sheet material processing device, and an infeed mechanism on the second sheet material processing device adapted to receive sheet material from the outfeed mechanism on the first sheet material processing device. An angularly adjustable guide mechanism is secured between the infeed mechanism of the first sheet material processing device and the outfeed mechanism of the second sheet material processing device. The guide mechanism can include a ramp member pivotably mounted on a pivot assembly. The pivot assembly can be provided as a pivot member secured to the ramp member, with a pair of pivot member support assemblies mounted adjacent to respective opposite sides of the ramp member. Each of the pivot support assemblies can include a slide member adapted to receive the pivot member, with a base member including an upright angular support wall. A connection device, which can be provided as a spring, secures the pivot member to the support wall of the base member. The ramp member itself can include a sheet material contact surface adapted to receive sheet material from the first sheet material processing device, and a contact portion adapted for contact with the first sheet material processing device. A connecting portion secures the sheet material contact surface to the contact portion. A method for guiding the transfer of sheet material from the first sheet material processing device to the second sheet material processing device is also set forth.

17 Claims, 2 Drawing Sheets

ADJUSTABLE RAMP FOR SHEET MATERIAL HANDLING DEVICES

FIELD OF THE INVENTION

The present invention relates to transporting sheet material between discrete sheet material handling devices. More specifically, the present invention relates to a sheet material transfer guide in a sheet material handling system including multiple, serial sheet material processing devices.

BACKGROUND OF THE INVENTION

Imaging systems such as printers, fax machines, and copiers are virtually omnipresent, and can be found in homes and offices worldwide. The development of such systems has facilitated improvements in communication that have in turn fostered an enormous change in the way people live and work. Telecommuting, paperless offices, and intra-office networks represent but a few examples of the advancements that have been made possible by modern imaging systems.

Imaging systems have become relatively sophisticated in response to consumer demands. It is not uncommon to find imaging systems associated with output systems capable of collating, sorting, and stapling groups of documents. One example of such an output system a 3000-sheet stapler/stacker, available from Hewlett-Packard Company, for high-capacity HP LaserJet® printers. The 3000-sheet stapler/stacker, can be combined with the HP LaserJet® 8100 printer to conveniently provide reliable, high-volume printing and finishing for professional-looking documents. Using the HP LaserJet® 8100 printer, 3,000-sheet stapler/stacker, automatic duplexer and 2,000-sheet input tray together, users can quickly and easily print, staple and sort numerous copies of large documents on demand. Manuals, training packages and other lengthy printed materials that need to be updated frequently can now be created in-house, allowing businesses to save costs associated with outsourcing and inventory storage and control.

Although printers and output systems such as the HP LaserJet® 8100 printer and 3,000-sheet stapler/stacker work well in combination, they are separately functioning, self-contained units. As a consequence, sheet material must be transported across a gap between the output of one device and the input of the other via a physical joint between the devices. The physical joint requires relatively precise alignment between the devices. Different device heights, uneven mounting surfaces, or misaligned floor contact members such as feet or rollers can cause misalignment between the devices. Misalignment frequently causes the sheet material to jam, resulting in unsatisfactory system performance.

As seen in FIG. 1, a printer P is set up to transport sheet material M to a stapler/stacker S. The sheet material M is transported from the printer P by exit rollers R1, and is guided into the entry rollers R2 of the stapler/stacker S by an inclined nose piece N. If the printer P and the stapler/stacker S are misaligned, for example, tilted either toward or away from one another, the nose piece N will not be positioned at an optimal angle to guide the sheet material M along a proper path. Consequently, the sheet material M may bind up on the surface of the nose piece N, or catch an edge E of the entry port of the stapler/stacker S. As a result, the sheet material may be damaged, or become jammed in the stapler/stacker S.

It can thus be seen that the need exists for a transport guide that will reduce the problems associated with component misalignment in a multi-device sheet material handling system.

SUMMARY OF THE INVENTION

These and other objects are achieved by providing, in a sheet material handling system including a first sheet material processing device and a second sheet material processing device, a sheet material transfer guide. The transfer guide includes an outfeed mechanism on the first sheet material processing device, and an infeed mechanism on the second sheet material processing device adapted to receive sheet material from the outfeed mechanism on the first sheet material processing device. An angularly adjustable guide mechanism is secured between the outfeed mechanism of the first sheet material processing device and the infeed mechanism of the second sheet material processing device.

The infeed mechanism can include a nose piece, with the guide mechanism being secured to the nose piece.

The guide mechanism can include a ramp member pivotably mounted on a pivot assembly. The pivot assembly can be provided as a pivot member secured to the ramp member, with a pair of pivot member support assemblies mounted adjacent to respective opposite sides of the ramp member. Each of the pivot support assemblies can include a slide member adapted to receive the pivot member, with a base member including an upright angular support wall. A connection device, which can be provided as a spring, secures the pivot member to the support wall of the base member.

The ramp member itself can include a sheet material contact surface adapted to receive sheet material from the first sheet material processing device, and a contact portion adapted for contact with the first sheet material processing device. A connecting portion secures the sheet material contact surface to the contact portion.

A method for guiding the transfer of sheet material from the first sheet material processing device to the second sheet material processing device is also set forth. In a first step, an angularly adjustable guide mechanism is secured between the outfeed mechanism of the first sheet material processing device and the infeed mechanism of the second sheet material processing device. Next, the angular position of the guide mechanism is adjusted to lead from the outfeed mechanism of the first sheet material processing device to the infeed mechanism of the second sheet material processing device. The first sheet material processing device is then actuated to transfer sheet material to the second sheet material processing device.

The features of the invention believed to be patentable are set forth with particularity in the appended claims. The invention itself, however, both as to organization and method of operation, together with further objects and advantages thereof, may be best understood by reference to the following description taken in conjunction with the accompanying drawings.

DETAILED DESCRIPTION OF THE INVENTION

Figure 1:
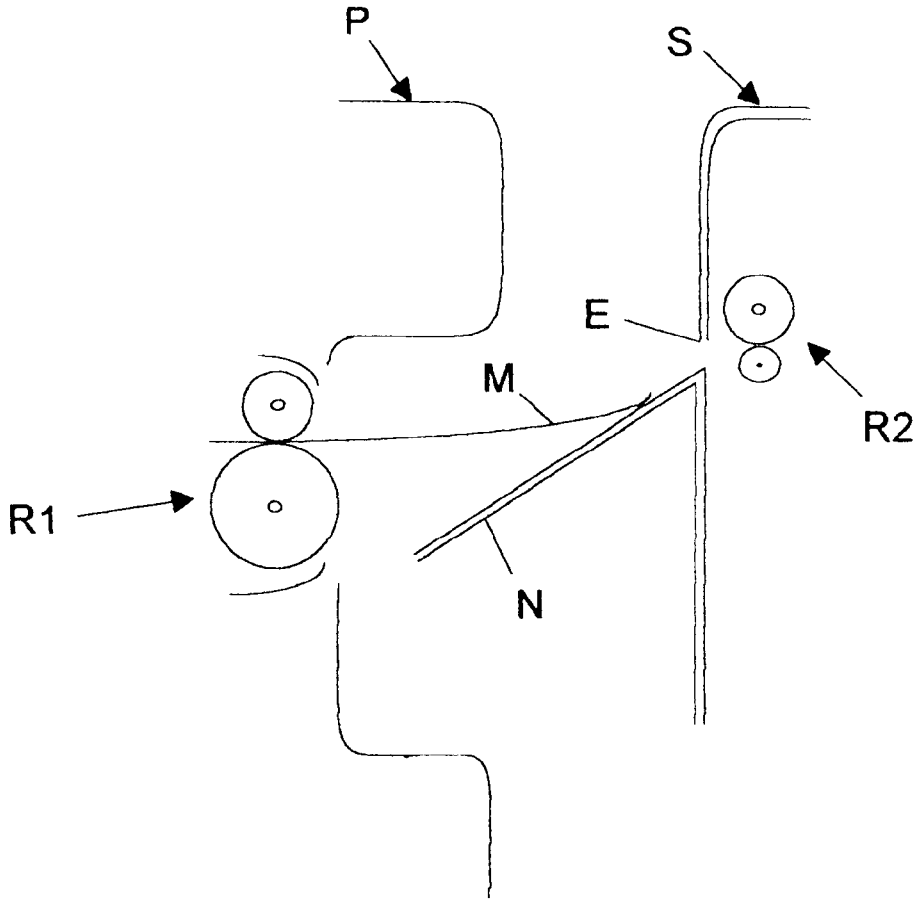
FIG.1 BACKGROUND ART
FIG. 1 is a schematic illustration of an imaging system representing background art.

An angularly adjustable transfer guide 10 in accordance with the principles of the present invention is shown in FIG.

2. The transfer guide 10 includes an angularly adjustable guide mechanism 12 secured between an outfeed mechanism 14 of the first sheet material processing device D1 and an infeed mechanism 16 of the second sheet material processing device D2. The infeed mechanism 16 includes a nose piece 18 to which the guide mechanism 12 is secured.

Figure 3:
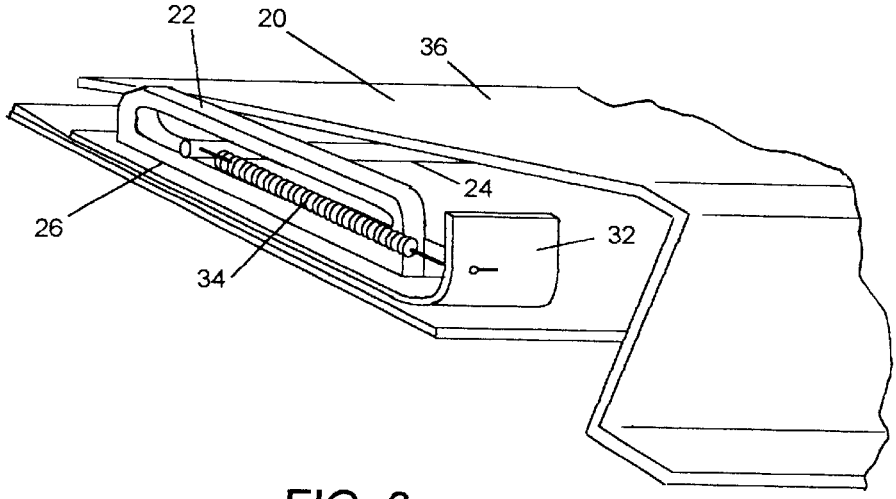
FIG. 3 is a perspective view, partially broken away, of an angularly adjustable transfer guide in accordance with the principles of the present invention.

The guide mechanism 12 includes a ramp member 20 pivotably mounted on a pivot assembly 22. The pivot assembly 22 is provided as a pivot member 24 secured to the ramp member 22. A pair of pivot member support assemblies 26, as seen in FIG. 3, are mounted adjacent to respective opposite sides of the ramp member 20. Each of the pivot support assemblies 26 includes a slide member 28 adapted to receive the pivot member 24 in sliding relation. The slide member 28 includes a base member 30 and an upright angular support wall 32. A connection device, here provided as a spring 34, secures the pivot member 24 to the support wall 32 of the slide member 28.

The ramp member 20 includes a sheet material contact surface 36 adapted to receive sheet material from the first sheet material processing device. A contact portion 38 of the ramp member 20 is adapted for contact with the first sheet material processing device D1. A connecting portion 40 secures the sheet material contact surface 36 to the contact portion 38.

Figure 2:
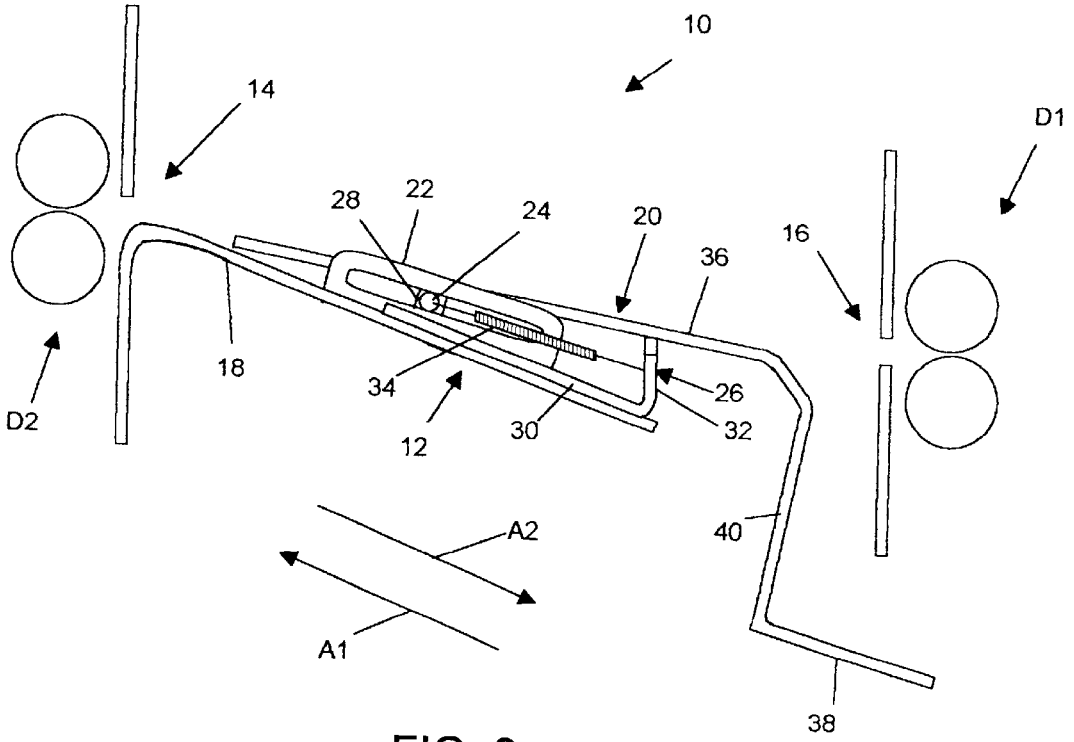
FIG. 2 is an elevational view of an angularly adjustable transfer guide in accordance with the principles of the present invention.

In operation, the guide mechanism 12 is first secured between the outfeed mechanism 14 of the first sheet material processing device D1 and the infeed mechanism 16 of the second sheet material processing device D2. The ramp member is then adjusted to its optimal position, that is, one which provides an accurate and direct angular connection between the outfeed mechanism 14 of the first sheet material processing device D1 and the infeed mechanism 16 of the second sheet material processing device D2. As can be seen in FIG. 2, since the position of the wall 32 is fixed, movement of the ramp member 20 in the direction of arrow A1 will cause the ramp to be more horizontal, while movement of the ramp member 20 in the direction of arrow A2 will cause the ramp to be more vertical. The spring 34 biases the ramp member 20 into a fixed position.

The present invention provides several distinct advantages. It is adjustable to a wide variety of positions to accommodate various device placement situations. It is relatively simple in construction, and can be fabricated from materials such as thermoplastics to minimize cost and weight. The present invention is not device-specific, and will thus function with any sheet material transfer device irrespective of manufacturer. Furthermore, the guide of the present invention requires no modification to existing imaging system components.

Although the present invention has been described with reference to specific embodiments, those of skill in the art will recognize that changes may be made thereto without departing from the scope and spirit of the invention as defined by the appended claims.

What is claimed is:

1. In a sheet material handling system including a first sheet material processing device and a second sheet material processing device, a sheet material transfer guide comprising the following:

an outfeed mechanism on the first sheet material processing device;

an infeed mechanism on the second sheet material processing device adapted to receive sheet material from the outfeed mechanism on the first sheet material processing device; and an angularly adjustable guide mechanism secured between the outfeed mechanism of the first sheet material processing device and the infeed mechanism of the second sheet material processing device, wherein the infeed mechanism comprises a nose piece, and the guide mechanism is secured to the nose piece.

2. A sheet material transfer guide in accordance with claim 1, wherein the guide mechanism comprises a ramp member pivotably mounted on a pivot assembly.

3. In a sheet material handling system including a first sheet material processing device and a second sheet material processing device, a sheet material transfer guide comprising the following:

an outfeed mechanism on the first sheet material processing device;

an infeed mechanism on the second sheet material processing device adapted to receive sheet material from the outfeed mechanism on the first sheet material processing device;

an angularly adjustable guide mechanism secured between the outfeed mechanism of the first sheet material processing device and the infeed mechanism of the second sheet material processing device, wherein the guide mechanism comprises a ramp member; and a pivot assembly including a pivot member secured to the ramp member, and a pair of pivot support assemblies mounted adjacent to respective opposite sides of the ramp member.

4. A sheet material transfer guide in accordance with claim 3, wherein each of the pivot support assemblies comprises the following:

a slide member adapted to receive the pivot member;

a base member including an upright angular support wall; and a connection device securing the pivot member to the support wall of the base member.

5. A sheet material transfer guide in accordance with claim 4, wherein the connection device comprises a spring.

6. In a sheet material handling system including a first sheet material processing device and a second sheet material processing device, a sheet material transfer guide comprising the following:

an outfeed mechanism on the first sheet material processing device;

an infeed mechanism on the second sheet material processing device adapted to receive sheet material from the outfeed mechanism on the first sheet material processing device;

an angularly adjustable guide mechanism secured between the outfeed mechanism of the first sheet material processing device and the infeed mechanism of the second sheet material processing device, wherein the guide mechanism comprises a ramp member including a sheet material contact surface adapted to receive sheet material from the first sheet material processing device a contact portion adapted for contact with the first sheet material processing device, and a connecting portion securing the sheet material contact surface to the contact portion.

7. In a sheet material handling system including a first sheet material processing device having an outfeed mechanism including an exit roller assembly and a second sheet material processing device having an infeed mechanism including an entry roller assembly and a nose piece, a sheet material transfer guide comprising the following:

an angularly adjustable guide mechanism secured on the nose piece at a position between the outfeed mechanism of the first sheet material processing device and the infeed mechanism of the second sheet material processing device.

8. In a sheet material handling system including a first sheet material processing device having an outfeed mechanism including an exit roller assembly and a second sheet material processing device having an infeed mechanism including an entry roller assembly, a sheet material transfer guide comprising the following:

an angularly adjustable guide mechanism secured between the outfeed mechanism of the first sheet material processing device and the infeed mechanism of the second sheet material processing device, wherein the guide mechanism comprises a ramp member pivotably mounted on a pivot assembly.

9. A sheet material transfer guide in accordance with claim 8, wherein the pivot assembly comprises the following:

a pivot member secured to the ramp member; and a pair of pivot support assemblies mounted adjacent to respective opposite sides of the ramp member.

10. A sheet material transfer guide in accordance with claim 9, wherein each of the pivot support assemblies comprises the following:

a slide member adapted to receive the pivot member;

a base member including an upright angular support wall; and a connection device securing the pivot member to the support wall of the base member.

11. A sheet material transfer guide in accordance with claim 10, wherein the connection device comprises a spring.

12. A sheet material transfer guide in accordance with claim 8, wherein the ramp member comprises the following:

a sheet material contact surface adapted to receive sheet material from the first sheet material processing device;

a contact portion adapted for contact with the first sheet material processing device; and a connecting portion securing the sheet material contact surface to the contact portion.

13. In a sheet material handling system including a first sheet material processing device having an outfeed mechanism including an exit roller assembly, and a second sheet material processing device having an infeed mechanism including an entry roller assembly and a nose piece, method for guiding the transfer of sheet material from the first sheet material processing device to the second sheet material processing device the method comprising the following steps:

providing an angularly adjustable guide mechanism secured between the outfeed mechanism of the first sheet material processing device and the infeed mechanism of the second sheet material processing device and securing the guide mechanism to the nose piece;

adjusting the angular position of the guide mechanism to lead from the outfeed mechanism of the first sheet material processing device to the infeed mechanism of the second sheet material processing device; and actuating the first sheet material processing device to transfer sheet material to the second sheet material processing device.

14. In a sheet material handling system including a first sheet material processing device having an outfeed mechanism including an exit roller assembly, and a second sheet material processing device having an infeed mechanism including an entry roller assembly, method for guiding the transfer of sheet material from the first sheet material processing device to the second sheet material processing device, the method comprising the following steps:

providing an angularly adjustable guide mechanism secured between the outfeed mechanism of the first sheet material processing device and the infeed mechanism of the second sheet material processing device and providing a guide mechanism including a ramp member pivotably mounted on a pivot assembly;

adjusting the angular position of the guide mechanism to lead from the outfeed mechanism of the first sheet material processing device to the infeed mechanism of the second sheet material processing device; and actuating the first sheet material processing device to transfer sheet material to the second sheet material processing device.

15. A method in accordance with claim 14, wherein the step of providing an angularly adjustable guide mechanism further comprises providing a ramp member including the following:

a sheet material contact surface adapted to receive sheet material from the first sheet material processing device;

a contact portion adapted for contact with the first sheet material processing device; and a connecting portion securing the sheet material contact surface to the contact portion.

16. In a sheet material handling system including a first sheet material processing device having an outfeed mechanism including an exit roller assembly, and a second sheet material processing device having an infeed mechanism including an entry roller assembly, method for guiding the transfer of sheet material from the first sheet material processing device to the second sheet material processing device, the method comprising the following steps:

providing an angularly adjustable guide mechanism secured between the outfeed mechanism of the first sheet material processing device and the infeed mechanism of the second sheet material processing device and providing a pivot assembly including a pivot member secured to the ramp member; and a pair of pivot support assemblies mounted adjacent to respective opposite sides of the ramp member;

adjusting the angular position of the guide mechanism to lead from the outfeed mechanism of the first sheet material processing device to the infeed mechanism of the second sheet material processing device; and actuating the first sheet material processing device to transfer sheet material to the second sheet material processing device.

17. A method in accordance with claim 16, wherein the step of providing an angularly adjustable guide mechanism further comprises providing a pivot assembly wherein each of the pivot support assemblies includes the following:

a slide member adapted to receive the pivot member;

a base member including an upright angular support wall; and a connection device securing the pivot member to the support wall of the base member.

* * * * *